US005160906A

United States Patent [19]

Siomkos et al.

[11] Patent Number: 5,160,906

[45] Date of Patent: Nov. 3, 1992

[54] MICROSTRIPE FILTER HAVING EDGE FLARED STRUCTURES

[75] Inventors: John R. Siomkos, Royal Palm Beach, Fla.; Philip M. Huang, Sunrise, Ill.

[73] Assignee: Motorola, Inc., Schaumburg, Ill.

[21] Appl. No.: 720,143

[22] Filed: Jun. 24, 1991

[51] Int. Cl.[5] ..... H01P 1/203; H01P 7/08

[52] U.S. Cl. ..... 333/204; 333/219

[58] Field of Search ..... 333/202-205, 333/219, 238, 246

[56] References Cited

U.S. PATENT DOCUMENTS

| | | | |
|---|---|---|---|
| 3,879,690 | 4/1975 | Golant et al. | 333/204 |
| 3,961,296 | 6/1976 | Wiggenhorn | 333/238 |
| 4,418,324 | 11/1983 | Higgns | 333/204 |
| 4,419,289 | 1/1984 | Higgins, Jr. et al. | 333/204 |
| 4,785,271 | 11/1988 | Higgins, Jr. | 333/204 |
| 4,918,050 | 4/1990 | Dworsky | 505/1 |
| 4,940,955 | 7/1990 | Higgins, Jr. | 333/219 X |
| 4,967,171 | 10/1990 | Ban et al. | 333/204 X |

FOREIGN PATENT DOCUMENTS

| | | | |
|---|---|---|---|
| 0161802 | 7/1986 | Japan | 333/204 |
| 0158801 | 6/1989 | Japan | 333/238 |

OTHER PUBLICATIONS

"Microwave Filters, Impedance-Matching Networks, and Coupling Structures", Matthaei, et al., Copyright 1980. Reprint of Edition Published by McGraw-Hill Book Co., Inc. in 1964.

*Primary Examiner*—Eugene R. LaRoche
*Assistant Examiner*—Seung Ham
*Attorney, Agent, or Firm*—Juliana Agon

[57] ABSTRACT

A transmission line structure comprises a dielectric substrate (11) having first and second opposing sides separated by a first distance (3). A transmission line (13) is disposed on the first side while an opposed conductor (12) is disposed on the second side. The transmission line (13) has a first edge (4) a second edge (6), and a midde portion (8). Thicknesswise, the middle portion (8) is separated from the opposed conductor by the first distance (3), and at least a portion of the first edge (4) is separated from the opposed conductor by a second distance less than the first distance (3).

8 Claims, 2 Drawing Sheets

15

20

MICROSTRIPE FILTER HAVING EDGE FLARED STRUCTURES

TECHNICAL FIELD

This invention relates generally to transmission line structures, and particularly to a transmission line structure formed on a substrate for radio applications where relatively small size is important.

BACKGROUND

There are many applications where it is necessary to provide a relatively small, low-loss transmission line structure for radio frequency signals. One such application is in modern communications systems, where it is desirable to provide a radio transceiver which packs higher performance and greater efficiency into a package having smaller size and lighter weight.

Transmission line structures, such as resonators or filters, can be formed on dielectric substrates. For example, conventional stripline or microstrip resonators typically utilize a substrate which can be a ceramic or another dielectric material. For microstrip construction a metallized runner comprising one or more resonators or conductors is formed on one side of the substrate with a ground plane on the other side. The stripline configuration utilizes two such structures with ground planes on the outside and the runner therebetween.

Although the stripline resonator structure described above performs acceptably as a resonator, current bunching occurs at the cross-sectional corners of the conductor runner located between the two dielectric substrates. This non-uniform current density or current bunching results from sharpness of the corners of the runner. Ideally, for uniform current density, the conductor should be cylindrical as in some block filters. Because of the sharp corners, the resultant non-uniform current density of the conductor effectively increases the resistance exhibited by the resonator. It is well known that such increases in resonator resistance correspondingly degrades the quality factor or Q of the resonator.

For purposes of this document, $Q_U$ is defined as the unloaded quality factor of a particular resonator which is uncoupled to any adjacent resonators. $Q_L$ is defined as the loaded quality factor of a particular resonator which is coupled to a resistive source or load. The ratio $Q_L/Q_U$ of adjacent or edge coupled resonators determines the passband insertion loss of a stripline filter which employs such resonators. Thus resonators with a low QL/QU ratio result in filters with low insertion loss. That is, the higher unloaded Q or $Q_U$ for a given $Q_L$, then the lower is the insertion loss of the stripline resonator filter. Hence, non-uniform current distribution in resonators result in higher resistance which also results in lower unloaded Q or higher insertion loss.

To combat current bunching at the resonator corners, one prior art method provided an elliptically shaped resonator structure by locating the center resonators or runners in grooves that were elliptical or at least substantially rectangularly shaped with rounded corners to approach the ideal "smooth" circular shape. However, in manufacturing, the structure of ceramic substrates does not lend itself easily to a groove having rounded corners.

In addition, since the groove increases the effective thickness (t) of the conductor as compared to a thin metallized layer conventionally deposited on top of the dielectric, the thickness of the dielectric (b) also had to be increased to maintain an optimum t/b ratio. Hence, the overall size of the stripline will correspondingly increase in height. It is a well established relationship or ratio that for a certain cross-sectional thickness "t" of the center conductor, there is a distance "b" between the opposing ground planes of the stripline that is required for an optimum unloaded Q or $Q_L$ to provide an optimum characteristic impedance and a resultant low insertion loss. However, as more dielectric material is needed to grow the stripline in height, the more expensive the stripline becomes.

Another major problem with microstrip filters in the past has been in coupling the individual edge coupled resonators. In conventional microstrip transmission lines, the amount of coupling between adjacent resonators is limited to how close the lines are capable of being deposited. Electrical coupling between the edge coupled conductive strips or resonator runners is achieved by means of fringing electromagnetic fields associated with each conductive strip or resonator. The fringing electromagnetic field of a single strip affects adjacent strips to a degree dependent upon the physical distance between the two adjacent strips. Increased coupling is desired since as the coupling is increased, the bandwidth of the filter also increases as the selectivity, Q, and insertion decrease. Thus a wider bandwidth also reduces the insertion loss of the filter.

Hence, a low cost and miniature microstrip or stripline resonator that provides increased coupling or optimum characteristic impedance while keeping insertion loss relatively low is desired.

SUMMARY OF THE INVENTION

Briefly, according to the invention, a transmission line structure comprises a dielectric substrate having first and second opposing sides separated by a first distance. A transmission line is disposed on the first side while an opposed conductor is disposed on the second side. The transmission line has a first edge, a second edge, and a middle portion. Thicknesswise, the middle portion is separated from the opposed conductor by the first distance, and at least a portion of the first edge is separated from the opposed conductor by a second distance less than the first distance.

DETAILED DESCRIPTION OF THE PREFERRED EMBODIMENT

Figure 1:
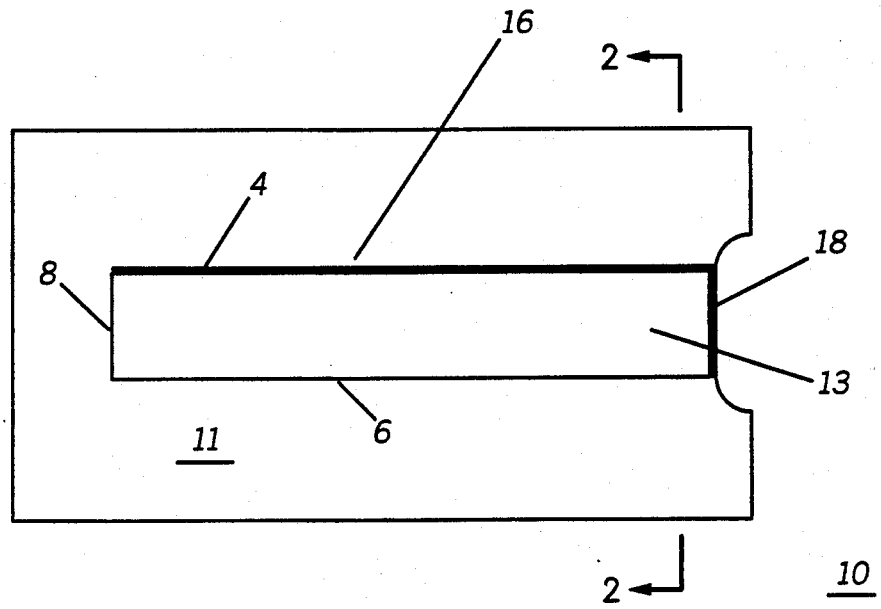
FIG. 1 is a top plan view of a transmission line structure in accordance with the present invention.
Figure 2:
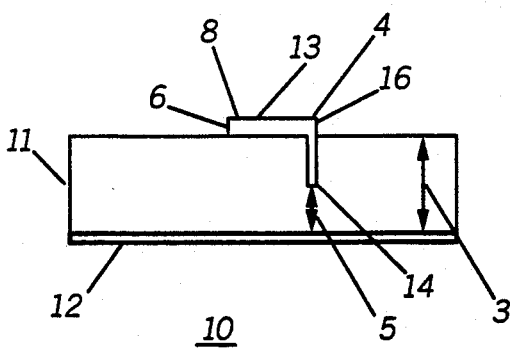
FIG. 2 is a cross-sectional view taken on line 2—2 of FIG. 1.

Referring to FIGS. 1 and 2, it will be understood that transmission line structure, comprising a microstrip filter 10, includes a dielectric substrate 11 having a conductive ground plane 12 disposed on a first side and a conductive or transmission line, strip, or resonator 13 disposed on the opposed second side. The first and second opposing sides are separated by a first distance 3. The ground plane 12 provides an opposed conductor to the conductive line 13. On the other side, the transmission line 13 includes a first edge 4, a second edge 6, and a middle portion 8. The middle portion 8 is separated from the opposed conductor 12 by the first distance 3, and at least a portion of the first edge 4 is separated from the opposed conductor 12 by a second distance 5 less than the first distance 3.

Figure 3:
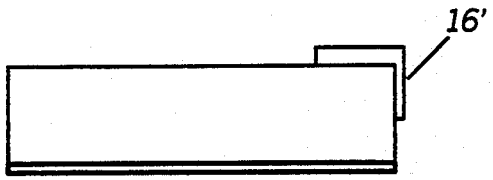
FIG. 3 is a cross-sectional view of another embodiment of a transmission line structure in accordance with the present invention.

The substrate 11 includes a thin elongated area or slit 14 of reduced thickness, with the line 13 extending at least into a portion of this area to form a flared edge 16. This flared edge 16 may be provided by a laser cut before metallization to keep the flared section as thin as possible. As shown in FIG. 1, the elongated area 14 is continuous along one entire edge of the line 13 resulting in a constant impedance, but the elongated area could also only be at one desired corner or anywhere along the edge portion. Thus, the line 13 will correspondingly have increased thickness on at least a part of one of its edges to comprise an elongated, thickened, or flared edge. At the area 14, the line 13 is more closely spaced (5) to the ground plane 12; thereby providing increased capacitance and decreased inductance per unit length to lower the characteristic impedance of the transmission line. Instead of being suspended in the dielectric 11 as shown in FIG. 2, the thicker part or flared edge 16' may also be suspended in air as is shown in FIG. 3 and may have other possible geometries.

The conductive line 13 open on one end is connected to the ground plane 12 by edge metallization 18 on the other opposed end, as is conventional in a quarter wavelength resonant line. On the other hand, if other segments of a wavelength are used, as with conventional half-waves, the conductive line is open and ungrounded on both ends. If desired, one or more tap connections can be provided to the conductive line 13.

Figure 4:
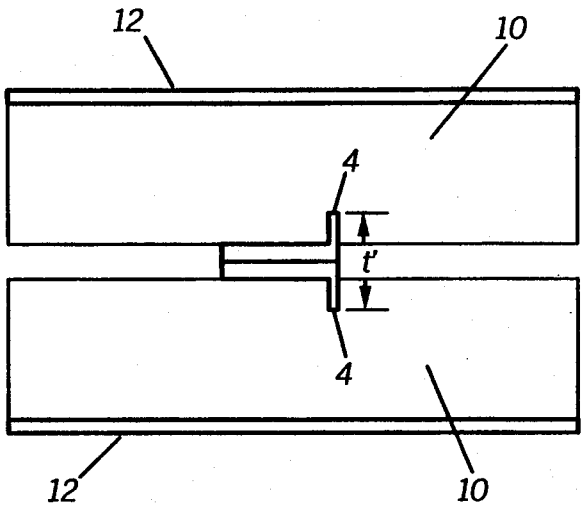
FIG. 4 is a cross-sectional view of a stripline structure in accordance with the present invention.

FIG. 4 illustrates a transmission line structure 15 that is constructed as a stripline rather than as a microstrip. Two microstrip structures 10 are utilized to form a resonator or conductive strip 20. In this embodiment both include the reduced substrate thickness areas or cavities to provide increased capacitance to the ground planes 12 at one edge 4 of the conductive lines 13. Such assembly techniques for stripline filters is well known in the art.

Figure 5:
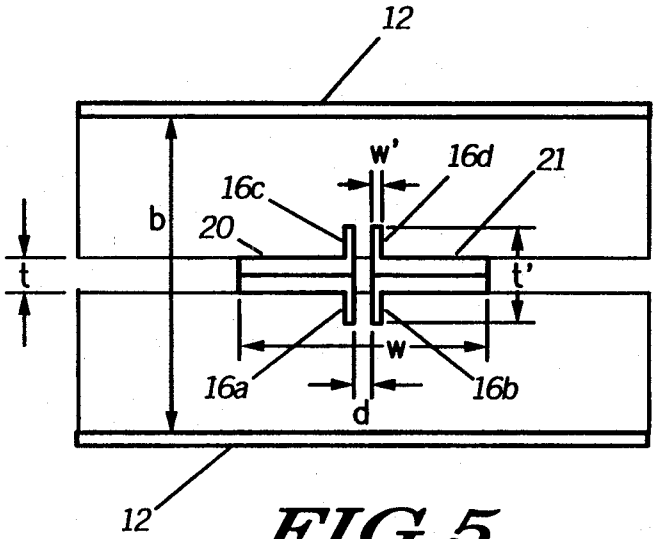
FIG. 5 is a cross-sectional view of edge coupled conductive strips in a stripline structure in accordance with the present invention.
Figure 6:
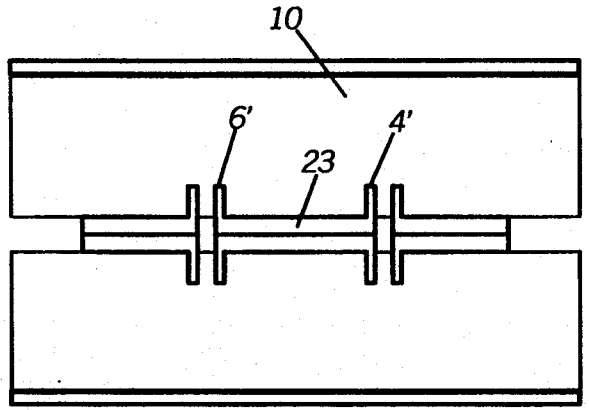
FIG. 6 is a cross-sectional view of three edge coupled conductive strips in a stripline structure in accordance with the present invention.

FIG. 5 shows a stripline filter having two edge coupled or adjacent resonators 20, 21, arranged side-by-side to provide electrical coupling therebetween. The physical distance d between adjacent resonators 20 and 21 plays a well known part in determining the nature of the coupling between the strips or resonators of the filter. This filter can be arranged in a comb-line or interdigital configuration. As is known, two or more resonators can be coupled in such a manner for a microstrip or stripline transmission line. For example, FIG. 6 shows a three resonator edge coupled stripline where the middle resonator 23 has both of its edges 4' and 6' flared. However for clarity sake, only the stripline configuration with two resonators will be described.

While the embodiments of FIGS. 1–6 provide a varying electromagnetic characteristic by disposing a portion of the line 13 in closer proximity to the ground plane 12, other characteristics could also be changed such as coupling, bandwidth, selectivity, insertion loss and characteristic impedance of the line. Referring back to FIG. 5, when a higher degree of coupling is required between resonators 20 and 21, the coupling edges **16*a–d*** are flared to provide an increased surface area for coupling. For cases where manufacturing tolerances prohibit less spacing (d for more coupling) between adjacent resonators, this additional vertical coupling dimension can be extremely useful.

Flaring the edges **16*a–d* of the resonators 20 and 21 also provides greater surface areas for a more uniform current distribution and therefore results in a higher unloaded Q or $Q_L$. However, the $Q_L$ for the flared edge is not as high as the $Q_L$ for the block or the elliptically grooved filters. The $Q_L$ is not as high since the optimum t/b ratio for the unflared part of the stripline is not maintained at the flared edge of the present invention, where the thickness t' has increased, but the spacing b between the ground planes is not proportionately increased. Therefore, to minimize loss in this non-optimum t'/b region, the surface area at the end of the flared edge, which approaches the ground plane 12** must have a width w' as a very small percentage of the overall width w of the transmission line since the width of the resonator transmission line also determines the insertion loss and the characteristic impedance.

In summary, the increased thickness t' of the flared edge presents a larger coupling surface area to an adjacent or edge coupled transmission line to provide for increased coupling. By using very thin flared edges, having a small width w', the ground plane to ground plane spacing b or profile is kept small as for a conventional stripline by optimizing the t/b relationship for the unflared portion of the resonator and allowing the flared portion having a t'/b ratio to be other than optimal. Since the flared edge is to be kept very thin, the loss encountered for the non-optimal t'/b will be minimal. Hence a transmission line structure lower profiled than a block filter is provided having increased coupling and an insertion loss between that of a conventional stripline and block filters. Thus by varying the substrate thickness, it is possible to construct a resonator or filter that utilizes less substrate material while providing an acceptable insertion loss. Additionally, structures can be constructed for greater coupling than was previously possible in a given size.

What is claimed is:

1. A transmission line resonator structure comprising:

a dielectric substrate having first and second opposing sides, the first and second opposing sides being separated by a first distance;

a transmission line disposed on the first side; and an opposed conductor disposed on the second side;

the transmission line having first and second edges and a middle portion, the middle portion being separated from the opposed conductor by the first distance, and at least a portion of the first edge forming an elongated portion extending towards the opposed conductor, the elongated portion being separated from the opposed conductor by a second distance which is less than the first distance, and the elongated portion having a thickness greater than the thickness of the middle portion.

2. The transmission line resonator structure as defined in claim 1, in which:

the opposed conductor is a ground plane parallel to the plane of the middle portion.

3. The transmission line resonator structure as defined in claim 1, in which:

the middle portion is in the same plane as the transmission line.

4. The transmission line resonator structure as defined in claim 1, in which:

the elongated portion has a width less than the width of the middle portion.

5. The transmission line resonator structure as defined in claim 1, in which:

the transmission line having a middle portion comprises the top surface of a rectangular strip.

6. The transmission line resonator structure as defined in claim 1, in which:

the dielectric substrate having at least a slit on the first side to receive the elongated portion.

7. A microstrip resonator structure comprising:

a dielectric substrate having first and second opposing sides, the first and second opposing sides being separated by a first distance;

a transmission line disposed on the first side;

an opposed conductor disposed on the second side; and the transmission line having first and second edges and a middle portion, the middle portion being separated from the opposed conductor by the first distance, and the first edge forming an elongated portion extending towards the opposed conductor the elongated portion being separated from the opposed conductor by a second distance less than the first distance, and the elongated portion having a thickness greater than the thickness of the middle portion.

8. A stripline filter structure comprising:

a pair of dielectric substrates, each having first and second opposing sides, the first and second opposing sides being separated by a first distance;

a plurality of stripline resonators disposed on the first side;

a ground plane disposed on the second side; and the stripline resonators each having first and second edges and a middle portion, the middle portion being separated from the ground plane by the first distance, and the first edge forming an elongated portion extending perpendicularly towards the ground plane, the elongated portion being separated from the ground plane by a second distance less than the first distance, and the elongated portion having a thickness greater than the thickness of the middle portion.

* * * * *